US008781384B2

(12) United States Patent
Kashiwakura et al.

(10) Patent No.: US 8,781,384 B2
(45) Date of Patent: Jul. 15, 2014

(54) CLEANING BLADE AND IMAGE FORMING APPARATUS

(75) Inventors: Kuniaki Kashiwakura, Toyohashi (JP); Tsugihito Yoshiyama, Toyohashi (JP); Yoshiki Nakane, Toyokawa (JP); Hokuto Hatano, Hachioji (JP); Yohei Ito, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 8 days.

(21) Appl. No.: 13/559,002

(22) Filed: Jul. 26, 2012

(65) Prior Publication Data

US 2013/0034375 A1 Feb. 7, 2013

(30) Foreign Application Priority Data

Aug. 2, 2011 (JP) ..... 2011-168857

(51) Int. Cl.
*G03G 21/00* (2006.01)

(52) U.S. Cl.
USPC ..... 399/350; 399/159; 399/249; 399/343

(58) Field of Classification Search
USPC ..... 399/99, 159, 249, 273, 283, 343, 350
See application file for complete search history.

(56) References Cited

U.S. PATENT DOCUMENTS

| | | | | |
|---|---|---|---|---|
| 6,777,524 | B1 | 8/2004 | Shimizu et al. | |
| 7,212,778 | B2 * | 5/2007 | Hisakuni | 399/350 |
| 7,805,103 | B2 | 9/2010 | Ueno et al. | |
| 8,126,385 | B2 | 2/2012 | Arai et al. | |
| 2007/0140762 | A1 * | 6/2007 | Ueno et al. | 399/350 |
| 2009/0003905 | A1 * | 1/2009 | Ueno et al. | 399/350 |
| 2010/0112481 | A1 * | 5/2010 | Kubota et al. | 430/286.1 |

FOREIGN PATENT DOCUMENTS

| | | |
|---|---|---|
| JP | 8-36338 | 2/1996 |
| JP | 8-166749 | 6/1996 |
| JP | 2007-193306 | 8/2007 |
| JP | 2008-32802 | 2/2008 |
| JP | 2008-262022 | 10/2008 |
| JP | 2008-268302 | 11/2008 |
| JP | 2008-268494 | 11/2008 |
| JP | 2008-268495 | 11/2008 |
| JP | 2008-268496 | 11/2008 |
| JP | 2009-031773 | 2/2009 |
| JP | 2010-181718 | 8/2010 |
| WO | WO-01/14444 | 3/2001 |

OTHER PUBLICATIONS

Notification of Reasons for Refusal mailed Oct. 8, 2013, directed to JP Application No. 2011-168857; 5 pages.

* cited by examiner

*Primary Examiner* — David Gray
*Assistant Examiner* — Francis Gray
(74) *Attorney, Agent, or Firm* — Lucas & Mercanti, LLP

(57) ABSTRACT

A cleaning blade, which is configured to be pressed against a toner image carrier that rotates in one direction, for removing residual toner from the toner image carrier, the cleaning blade having: a contact layer that is located in a side to come into contact with the toner image carrier; and a supporting layer that is located in a side not to come into contact with the toner image carrier, wherein tensile stress characteristic curves of a material of the contact layer and a material of the supporting layer intersect with each other. An image forming apparatus having a toner image carrier and the cleaning blade.

10 Claims, 5 Drawing Sheets

MATERIALS 1-7: FOR SUPPORTING LAYER

CLEANING BLADE AND IMAGE FORMING APPARATUS

This application is based on Japanese Patent Application No. 2011-168857 filed on August 2, 2011, the content of which is incorporated herein by reference.

BACKGROUND OF THE INVENTION

1. Field of the Invention

The present invention relates to a cleaning blade and an image forming apparatus, and particularly relates to a cleaning blade for removing residual toner from a surface of a toner image carrier and an image forming apparatus such as an electrophotographic copier or printer.

2. Description of Related Art

In recent years, in an electrophotographic image forming apparatus, improvements in image quality such as a higher resolution and higher photograph reproducibility have been demanded, and as an effective measure to meet the demand, size reduction or conglobation of toner particles has been proposed.

However, toner particles of a reduced size or conglobated toner particles are likely to pass through a space between a cleaning blade and a toner image carrier such as a photoreceptor or an intermediate transfer member. The reasons are as follows. A size reduction of toner particles strengthens the van der Waals force and accordingly strengthens the adhesive force between the toner and the image carrier, and toner particles of a reduced size are likely to get into a nip portion between the image carrier and the cleaning blade. Further, conglobated toner particles are likely to roll between the image carrier and the cleaning blade, and the rolling toner particles get into the nip portion easily.

When the toner passes through the cleaning blade (when a cleaning failure occurs), the toner that passed through the cleaning blade may be transferred to a subsequently formed image to cause black streaky noise, or the toner that passed through the cleaning blade may block light in a subsequent exposure process to cause a partial defect of an electrostatic latent image. Therefore, it is important to prevent the cleaning failure.

In order to ensure toner cleaning be successfully conducted, there has been taken a measure of not conglobating toner particles much but holding toner particles in some degree of amorphous state. Moreover, toner particles are coated with inorganic minute particles, called a cleaning aid, with a relatively large size of the order of several hundreds of nanometers to one micron meter. When a developer including toner particles coated with such a cleaning aid is stirred in a development unit, part of the cleaning aid is separated from the toner particles and charged. The separated part of the cleaning aid is then used for development, separately from the toner, and fed to a cleaning section. Also, there is some other part of the cleaning aid fed to the cleaning section along with the toner particles. The cleaning aid fed along with the toner particles is separated from the toner particles in a toner gathering portion formed by the blade.

The cleaning aid fed to the toner gathering portion of the blade functions in the following way. As shown in FIG. 6, the toner gathering portion formed by a cleaning blade 114 is in the shape of a wedge formed of the surface of an image carrier (photoreceptor 110) and the cleaning surface of the blade 114, and is closed at the downstream edge in a traveling direction of the photoreceptor 110 (see arrow a). Particles of the toner and the cleaning aid gathered in this wedge are arranged according to the particle size, in consequence of the travel (rotation) of the photoreceptor 110. Specifically, the smaller size the particle has, the closer to the tip of the wedge the particle is located. Accordingly, particles of the cleaning aid, which have smaller sizes than particles of the toner, are gathered in a deeper portion in the wedge than the toner. Then, some of the cleaning aid particles slip into the nip section between the blade 114 and the photoreceptor 110, due to the small particle size.

However, the cleaning aid particles that slipped into the nip section between the photoreceptor 110 and the blade 114 reduce the frictional force of the nip section, thereby preventing a rebound of the blade 114 and suppressing wear of the edge of the blade 114. Thus, the cleaning aid serves as a lubricant. Since the cleaning aid is continuously fed from the development unit to the surface of the photoreceptor 110 or is separated from the toner in the toner gathering portion, the cleaning aid that slipped into the nip section is compensated with the fed cleaning aid, and there is always a certain amount of cleaning aid in the toner gathering section. Then, the cleaning aid gathered in the gathering section blocks the toner from coming into the nip section. In other words, the toner is certainly cleaned.

Further, in order to facilitate cleaning of the toner, there has been proposed a measure of supplying a material onto the image carrier to lower the friction coefficient of the image carrier. For example, a solid lubricant, specifically, solidified zinc stearate is pressed against a rotary-driven brush and is scraped off by the brush, and the scraped lubricant is applied to the image carrier. The lubricant applied to the image carrier reduces the adhesive force of toner to the image carrier and reduces the frictional force between the toner and the image carrier, thereby allowing a cleaning blade or the like to remove the toner satisfactorily.

However, a large number of executions of image formation in the state where zinc stearate is sufficiently applied to the image carrier to reduce the friction coefficient causes a problem in that the cleaning blade is worn to a more serious degree, compared with a case where zinc stearate is not applied, even though the application of zinc stearate to the image carrier has an effect on suppression of the wear of the image carrier. This is caused by the following actions. Since the image carrier and the cleaning blade are rubbed against each other, there is a relation between the wear of the image carrier and the wear of the cleaning blade. A typical image carrier in use in recent years is an organic photoreceptor, and the portion of the organic photoreceptor to rub against the cleaning blade is mainly made of polycarbonate resin. For the cleaning blade, conventionally, polyurethane rubber has been used. Polycarbonate and urethane rubber are different in hardness, and specifically, polycarbonate is harder than urethane rubber. Therefore, when polycarbonate and urethane rubber are rubbed against each other, urethane rubber is worn.

However, as described above, the cleaning aid is present between the image carrier and the cleaning blade, and the cleaning aid constantly slips into the cleaning nip section. For this reason, the slip-in of the cleaning aid has great bearing on the wear of the image carrier and the wear of the cleaning blade. The cleaning aid particles that come into the nip section prevent the cleaning blade and the image carrier from coming into direct contact with each other, and further, the cleaning aid particles rolling into the nip section reduces the frictional force. Therefore, the wear of the edge of the cleaning blade in this case is significantly smaller than the wear of the edge of the cleaning blade that is caused by direct contact with the image carrier.

Meanwhile, the cleaning aid is likely to serve as an abrasive on the image carrier. Therefore, when no cleaning aid slips into the nip section, the wear of the image carrier is at the minimum degree. As the amount of cleaning aid slipping into the nip section becomes greater, the wear of the image carrier becomes to a greater degree. When a lubricant is applied to the image carrier to decrease the friction coefficient, a less amount of the cleaning aid slips into the nip section, and it becomes more likely that the image carrier and the cleaning blade come into direct contact with each other. This precipitates the wear of the cleaning blade. In this case, also, a decrease in the amount of cleaning aid slipping into the nip section leads to an increase in the frictional force, and the edge of the blade is pulled farther by the rotating image carrier and curves more. This accelerates the wear of the cleaning blade.

Moreover, when the edge of the blade curves more due to an increase in the frictional force, the blade is likely to rebound drastically and suddenly. The rebound of the blade causes not only a cleaning failure but also a damage on the image carrier. In this case, also, since the rotating image carrier pulls the edge of the blade strongly, the drive torque for rotating the image carrier increases extremely. Then, the increase in the drive torque may result in a breakdown of the driving device. Therefore, it is more important to prevent the rebound of the blade than to prevent the cleaning failure due to the wear of the edge of the blade.

In order to deal with the above problem, there has been considered a measure of heightening the hardness of the cleaning blade. When the hardness of the cleaning blade is heightened, the width of the edge of the cleaning blade to form the nip section (the width being hereinafter referred to as a nip width) is decreased. Since the frictional force is proportional to the contact area, the decrease in the nip width of the edge leads to a decrease in the frictional force. Further, the cleaning blade with high hardness is improved in wear resistance. The decrease in the frictional force and the improvement in the wear resistance have synergistic effect to suppress the wear of the cleaning blade. Moreover, the cleaning blade with high hardness is less likely to rebound, and the rebound of the blade can be prevented.

However, the cleaning blade with high hardness is unfavorable in view of permanent distortion, and is difficult to hold the initial contact state. That is, although heightening the hardness of the blade leads to prevention of the rebound of the blade and suppression of the wear of the edge of the blade, the blade with high hardness is difficult to hold an appropriate state to contact with the image carrier, which causes a cleaning failure. Thus, a problem in terms of the length of life of the cleaning blade is remained to be solved.

In order to achieve a cleaning blade with suppressed permanent distortion, improved wear resistance and less incidence of rebound, two-layer blade structures have been proposed. According to the structures, a blade is formed by laminating a contact layer including an edge made of urethane rubber and a supporting layer that supports the contact layer. A material with high hardness has been adopted for the contact layer to improve the wear resistance and to prevent the rebound, and a material with low hardness has been adopted for the supporting layer to suppress the permanent distortion (Japanese Patent Application Laid-Open Nos. 2008-268302, 2009-031773 and 2010-181718).

However, according to a study by the present inventors, it has been confirmed that physical properties of the material for the supporting layer are related to the wear and the rebound of the contact layer. It has been revealed that a two-layer blade with a supporting layer simply formed of a material with low hardness does not necessarily have improved wear resistance and less incidence of rebound and rather possibly has deteriorated wear resistance and more incidence of rebound than a single-layer blade with only a contact later.

SUMMARY OF THE INVENTION

A first aspect of the present invention provides a cleaning blade, which is configured to be pressed against a toner image carrier that rotates in one direction, for removing residual toner from the toner image carrier, and the cleaning blade comprises: a contact layer that is located in a side to come into contact with the toner image carrier; and a supporting layer that is located in a side not to come into contact with the toner image carrier, wherein tensile stress characteristic curves of a material of the contact layer and a material of the supporting layer intersect with each other.

A second aspect of the present invention provides an image forming apparatus comprising: a toner image carrier that rotates in one direction; and a cleaning blade, which is pressed against the toner image carrier, for removing residual toner from the toner image carrier, and the cleaning blade comprises: a contact layer that is in contact with the toner image carrier; and a supporting layer that is not contact with the toner image carrier, wherein tensile stress characteristic curves of a material of the contact layer and a material of the supporting layer intersect with each other.

BRIEF DESCRIPTION OF THE DRAWINGS

These and other features of the present invention will be apparent from the following description with reference to the accompanying drawings, in which.

DETAILED DESCRIPTION OF THE PREFERRED EMBODIMENTS

Hereinafter, embodiments of a cleaning blade and an image forming apparatus according to the present invention will be described with reference to the accompanying drawings. It should be noted that in each drawing, a reference symbol is commonly used for the same member or part, and a repeated description will be omitted.

Figure 1:
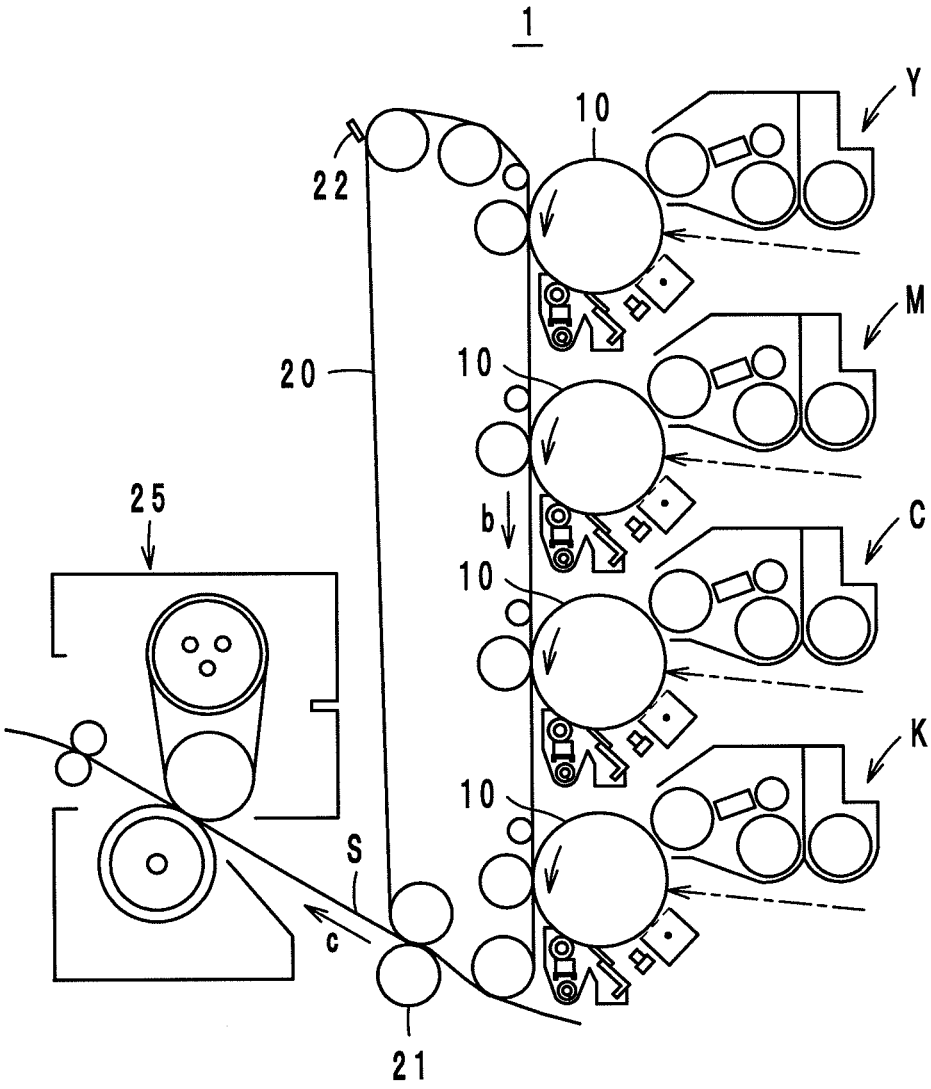
FIG. 1 is a schematic constitutional view showing a main part of an image forming apparatus.

As shown in FIG. 1, an image forming apparatus 1 is a tandem-type color printer, in which imaging units Y, M, C and K, each having a photosensitive drum 10 in the center, are arranged in the vertical direction. The unit Y forms a yellow image, the unit M forms a magenta image, the unit C forms a cyan image, and the unit K forms a black image. Toner images formed on the respective photosensitive drums 10 are transferred onto an intermediate transfer belt 20, which rotates in a direction shown by an arrow b, and are combined into one composite toner image (first transfer). Further, the composite toner image is transferred by a secondary transfer roller 21 to a record medium S that is fed in a direction shown by an arrow c (secondary transfer). The record medium S with the toner image transferred thereto is subjected to a heat treatment in a fixation unit 25 for fixation of toner thereon, and thereafter, the record medium S is discharged onto a tray (not shown).

Figure 2:
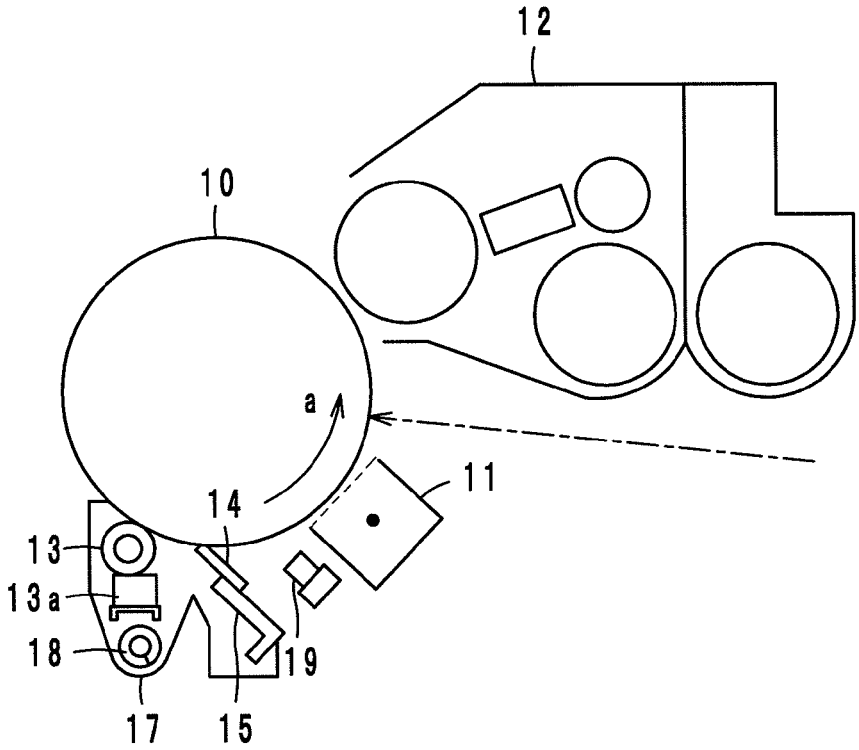
FIG. 2 is a sectional view showing a configuration of an imaging unit in the image forming apparatus.

As shown in FIG. 2, in each of the imaging units Y, M, C and K, a charger 11, a developer 12, a lubricant applicator 13, a cleaning blade 14 for removing residual toner and a static eliminator 19 for removing residual electric charge are arranged along a rotating direction a of the photosensitive drum 10. Further, an exposure unit (not shown) is arranged so as to expose the surface of each photosensitive drum 10. The toner removed from the photosensitive drum 10 by the cleaning blade 14 is dropped into a collection bath 17 and is carried by a screw 18 to a waste toner collection container (not shown). Further, residual toner on the intermediate transfer belt 20 is removed by a cleaning blade 22 (see FIG. 1). It is to be noted that the configuration and the function of equipment for electrophotograhic image formation, and electrophotographic image forming process are known, and the descriptions thereof are omitted.

The lubricant applicator 13 is a brush roller that is driven to rotate at a linear speed slower than that of the photosensitive drum 10, specifically, at a linear speed that is 0.4 times that of the photosensitive drum 10, counter to the photosensitive drum 10. The brush of the applicator 13 is conductive polyester with a resistance value of $10^9$ to $10^{10}\Omega$. The brush has a fiber thickness of 4 T (decitex), and a fiber density of 100 KF/inch$^2$. An iron shaft having a diameter of 6 mm is used as the shaft of the brush, and the brush has a diameter of 12 mm. Fibers are woven into a ground fabric having a thickness of about 0.5 mm, and the fibers have lengths of about 2.5 mm.

A solid lubricant 13*a* is formed by melting and shaping zinc stearate powder. Since the solid lubricant 13*a* is fragile and is likely to crack if remained as it stands, the solid lubricant 13*a* is bonded to a sheet-metal holder by a double-faced tape. Although not shown, the solid lubricant 13*a* is pressed to the applicator 13 by a compression spring to be supported by the applicator 13. While the applicator 13 is rotating with the solid lubricant 13*a* pressed thereto, the solid lubricant 13*a* is chipped off into power by the applicator 13, and the powdery lubricant is applied to the photosensitive drum 10.

The lubricant applied to the surface of the photosensitive drum 10 is then carried to the contact section with the cleaning blade 14, and is spread on the surface of the photosensitive drum 10 with the blade 14 to be formed into a film. The film of zinc stearate is characterized by functioning well as a mold release (having a high contact angle with pure water) and having a low friction coefficient. Therefore, the zinc stearate film formed on the photosensitive drum 10 facilitates transfer and cleaning of toner therefrom, as well as suppresses of wear of the photosensitive drum 10, thereby prolonging the life of the photosensitive drum 10.

The cleaning blade 14 for cleaning the photosensitive drum 10 will be hereinafter described. The description also applies to the cleaning blade 22 for cleaning the intermediate transfer belt 20.

Figure 3:
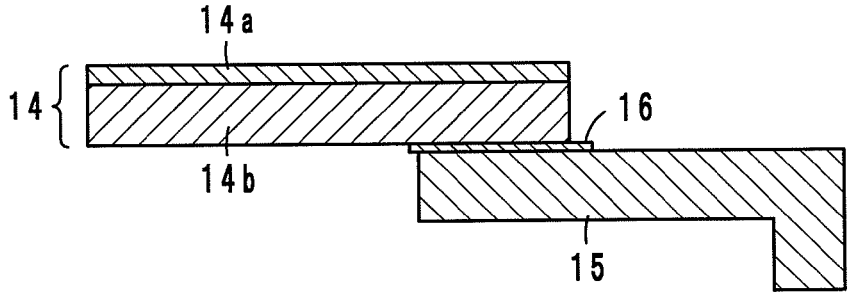
FIG. 3 is a sectional view showing the details of a cleaning blade.

As shown in FIG. 3, the cleaning blade 14 has a laminate structure formed of a contact layer 14*a* to come into contact with the surface of the photosensitive drum 10 and a supporting layer 14*b* to keep out of contact with the photosensitive drum 10, and the lower surface of the supporting layer 14*b* is fixed to a sheet-metal holder 15 via a hot-melt adhesive 16.

The cleaning blade 14 is a polyurethane rubber plate. A conventional single-layer cleaning blade is typically manufactured by a method as follows: a material in the form of a liquid is injected into a rotating drum of a centrifugal molding machine to be stretched uniformly inside the drum; and the stretched material is heated and reacted to harden. The thickness of the blade 14 is typically set to 2 mm. The hardened polyurethane rubber is rested for a curing period of several days to stabilize its reaction, and then cut into pieces of a predetermined size by a cutter.

The cleaning blade 14 of the two-layer structure is manufactured by the following process. A material (in the form of a liquid) for the supporting layer 14*b* is injected into a centrifugal molding machine and hardened into a sheet. Immediately, a material (in the form of a liquid) for the contact layer 14*a* is injected into the molding machine and hardened. In this way, a two-layer sheet is formed. The two-layer sheet is cured and then cut into pieces of a predetermined size, and the cut of the two-layer sheet is attached to the sheet-metal holder 15. During the curing of the two-layer sheet, the urethane bonding at the interface between the contact layer 14*a* and the supporting layer 14*b* is strengthened. Thereby, the two-layer sheet becomes like a single-layer sheet, and delamination of the two-layer blade 14 will never occur.

The thickness of the supporting layer 14*b* is preferably 1.5 mm, and the thickness of the contact layer 14*a* is preferably 0.5 mm. Therefore, the total thickness of the blade 14 is preferably 2.0 mm. The thicknesses of the layers 14*a* and 14*b* are designed to have such a relation for the following reasons. In order to minimize the incidence of permanent distortion, which is the object of the two-layer structure, the ratio of the supporting layer 14*b* to the contact layer 14*a* in the thickness shall be as large as possible. However, when the thickness of the contact layer 14*a* is designed 0.5 mm or less, errors in manufacturing the contact layer 14*a* affect its operation largely. Hence, it is considered reasonable to set the thicknesses of the layers 14*a* and 14*b* as recited above.

Figure 4:
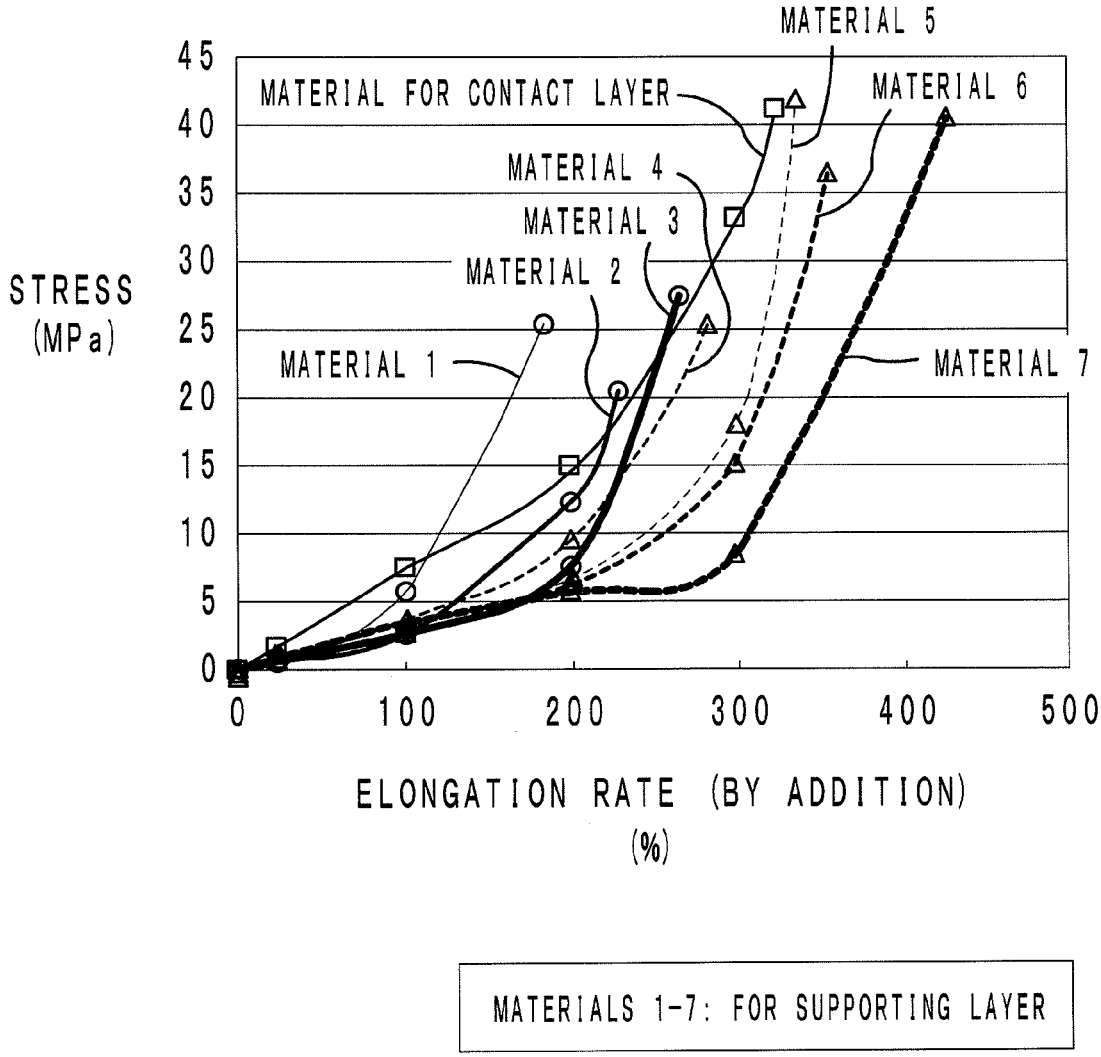
FIG. 4 is a graph showing tensile stress characteristics of a material for a contact layer and materials for a supporting layer of the cleaning blade.

Then, the material for the contact layer 14*a* and the material for the supporting layer 14*b* need to have respective tensile stress characteristics that curve to intersect with each other. Herein, the tensile stress characteristic means the relation between stress and elongation rate, and "the material for . . . and the material for . . . have respective tensile stress characteristics that curve to intersect with each other" means that one of the materials does not constantly have a greater stress than the other material while both the materials are elongated at any same rate but that there is an elongation rate at which the materials are reversed in the stress greatness. FIG. 4 shows the tensile stress characteristic of a material for the contact layer 14*a* (one curve connecting squares) and the tensile stress characteristics of materials for the supporting layer 14*b* (seven curves, in total, connecting circles and triangles). The tensile stress characteristics were measured by a method in accordance with JIS-K6251. The horizontal axis indicates elongation rate (%), and the vertical axis indicates stress (MPa). On each characteristic curve, the right end indicates the condition where the material ruptured.

As is apparent from these characteristic curves, there is an inflection point in a tensile stress characteristic curve of polyurethane rubber. For example, the tensile stress characteristic curve of the material 7 (comparative example) for a supporting layer has a tendency to be almost constant until the elongation rate increases up to about 280%, and has a tendency to increase after the elongation rate exceeds the point. This is attributed to the structural feature of polyurethane rubber. Polyurethane rubber is basically of a structure where elements called soft segments and elements called hard segments are mixed. As the names suggest, the soft segments are soft and have rubber elasticity, and the hard segments are hard and have strength. Therefore, while tensile force is increasingly applied to polyurethane rubber, the soft segments first begin to stretch, and when the soft segments are fully stretched, the hard segments begin to stretch. This is indicated by a tensile stress characteristic curve with an inflection point.

A characteristic value corresponding to the hardness is represented by a stress value in a low-elongation state where the elongation rate is 100% or less. It is considered that a state where the edge of the cleaning blade 14 is pressed by contact with the photosensitive drum 10 to form the nip section is a state where the stress value is about 5 MPa. Further, it is considered that a state where the edge of the cleaning blade 14 curves largely with frictional force additionally applied by the photosensitive drum 10 is a state where the stress value is about 15 to 30 MPa.

In FIG. 4, the curve connecting the squares indicates the characteristic of the material for the contact layer. In order to make the nip section smaller, it is preferred that a material with a small elongation rate under a stress of 5 MPa (a material with high hardness) is used as the material for the contact layer 14*a*. Moreover, in order to keep the edge from chipping even with increased frictional force applied thereto, the material for the contact layer 14*a* desirably has a characteristic that does not rupture even under 30 MPa. As a result of a variety of tests and studies made by the present inventors, it was revealed that the material showing the characteristic curve connecting the squares in FIG. 4 is suited for the contact layer 14*a*. Three kinds of materials 1 to 3 showing the respective characteristic curves connecting the circles (materials according to the embodiment) are suited for the supporting layer 14*b*. Four kinds of materials 4 to showing the respective characteristic curves connecting the triangles (comparative examples) are not suited for the supporting layer 14*b*. Under a stress of 5 MPa, the materials 1 to 3 and the materials 4 to 7 for the supporting layer 14*b* have higher elongation rates than the material for the contact layer 14*a* under the same stress. That is, those materials for the supporting layer 14*b* are low-hardness materials. Each of the materials 4 to 7 keeps higher elongation rates than the material for the contact layer 14*a* all through a low-stress state and a high-stress state, whereas each of the materials 1 to 3 for the supporting layer 14*b* has smaller elongation rates than the material for the contact layer 14*a* in a high-stress sate.

This characteristic of the materials 1 to 3 can be achieved by changing the amount of a cross-linker (especially a tri-functional cross-linker). The cross-linker serves to link pre-polymer linear components to form meshes. When the meshes are increased, the stretch of the soft segments is controlled, and the hard segments begin to stretch before the soft segments are fully stretched. That is, increasing the meshes without increasing the amount of hard segments in the material permits the material to have high tensile strength while keeping small hardness. In this way, the materials 1 to 3 for the supporting layer 14*b* can be obtained.

Figure 5A:
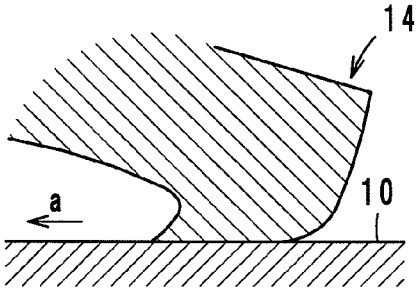
FIGS. 5A to 5D are sectional views showing various cleaning blades pressed against photosensitive drums.
Figure 5B:
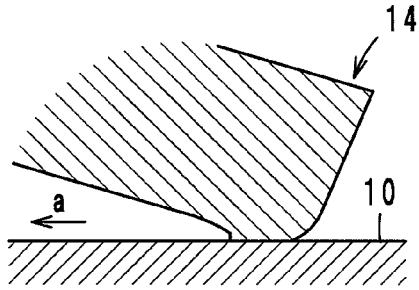

FIGS. 5A and 5B each show the state wherein the cleaning blade 14 of a single-layer structure is pressed onto the photosensitive drum 10. FIG. 5A shows the case of using a low hardness material (e.g., the material 7 shown in FIG. 4) for the single-layer cleaning blade 14. In this case, the nip width is large with respect to the pressing force, and the frictional force received from the photosensitive drum 10 is large. Because the cleaning blade 14 receives the large frictional force and because the material has a high elongation rate under a high stress, the edge curves largely. For this reason, the blade shown by FIG. 5A is readily worn, and the blade is likely to rebound. FIG. 5B shows the case of using a high hardness material (e.g., the material for the contact layer shown in FIG. 4) for the single-layer cleaning blade 14. In this case, the nip width is small with respect to the pressing force, and the frictional force received from the photosensitive drum 10 is also small. Because the cleaning blade 14 does not receive so large frictional force, the edge does not curve so largely. Therefore, the cleaning blade made of the high-hardness material is more durable and is less likely to rebound than the cleaning blade made of the low-hardness material.

Figure 5C:
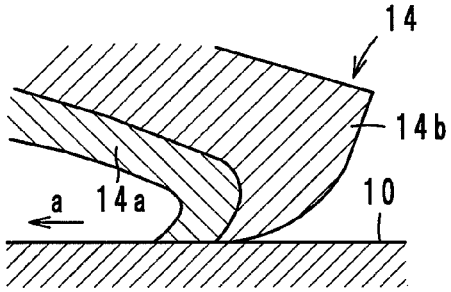
Figure 5D:
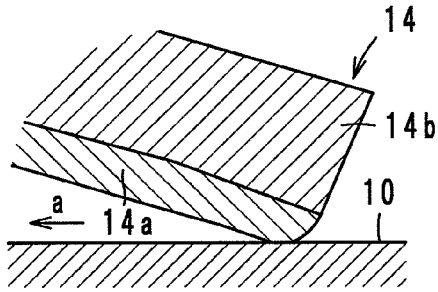
Figure 6:
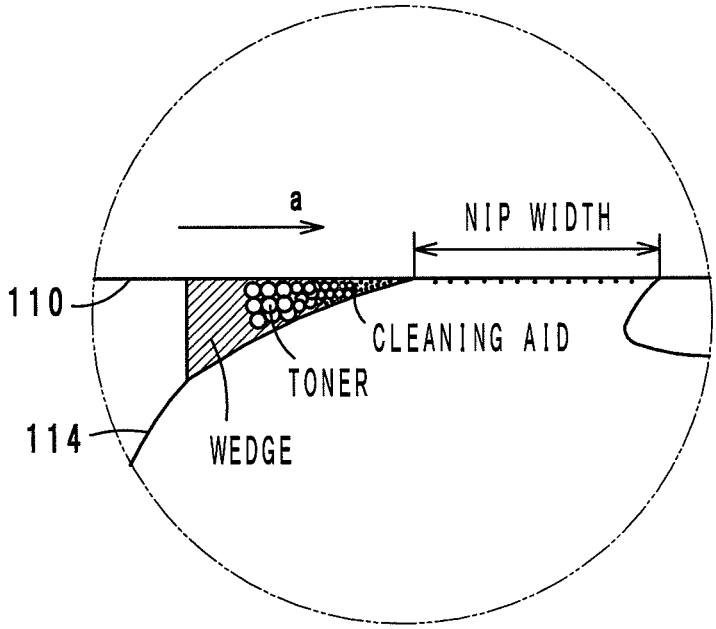
FIG. 6 is an explanatory view showing a state where the cleaning blade is pressed against a photosensitive drum.

FIGS. 5C and 5D each show the state wherein the cleaning blade 14 of a two-layer structure is pressed onto the photosensitive drum 10. FIG. 5C is a comparative example, and FIG. 5D is an example of the present invention. In the comparative example shown by FIG. 5C, a material that curves more in reaction to a frictional force and a material that curves less in reaction to the frictional force are used for the supporting layer 14*b* and for the contact layer 14*a*, respectively. In this case, the nip width is small, and in the beginning, the frictional force received from the photosensitive drum 10 is small. However, as the cleaning blade is continuously rubbed against the photosensitive drum 10, the supporting layer 14*b* curves more and more by the accumulated frictional force, and finally, the edge curves largely. Consequently, the frictional force becomes large, and the wear of the cleaning blade shown by FIG. 5C becomes larger than that of the single-layer blade shown by FIG. 5B. Also, the cleaning blade shown by FIG. 5C becomes likely to rebound. In the example of the present invention shown by FIG. 5D, a material that curves less in reaction to a frictional force and a material that curves more in reaction to the frictional force are used for the supporting layer 14*b* and for the contact layer 14*a*, respectively. In this case, the nip width is small, and the frictional force received from the photosensitive drum 10 is also small. Therefore, the edge curves less than that of the single-layer blade shown by FIG. 5B. Thus, the cleaning blade shown by FIG. 5D is favorable in terms of both wear and rebound.

Table 1 below shows evaluations of various blades on the effect of preventing a rebound and on the picture quality of continuously formed images. The evaluated blades are, specifically, a single-layer blade made of the material for the contact layer shown in FIG. 4 (reference), and two-layer blades respectively with supporting layers made of the materials 1 to 7 in addition to the contact layer made of the material therefor shown in FIG.4. A4-size sheets were fed through the apparatus with the respective shorter sides parallel to the feeding direction, and images formed thereon were examined. The thickness of the contact layer 14*a* was 0.5 mm, and the thickness of the supporting layer 14*b* was 1.5 mm. In Table 1, 25%-modulus, 100%-modulus, 200%-modulus and 300%-modulus respectively mean stresses (MPa) applied to the materials when the materials are elongated by the additions of 25%, 100%, 200% and 300%, respectively.

TABLE 1

| | Reference | Material 1 | Material 2 | Material 3 | Material 4 | Material 5 | Material 6 | Material 7 |
|---|---|---|---|---|---|---|---|---|
| Blade Structure | Single-Layer | Two-Layer | Two-Layer | Two-Layer | Two-Layer | Two-Layer | Two-Layer | Two-Layer |
| 25%-Modulus | 2.1 | 1.3 | 1.0 | 1.2 | 1.3 | 1.2 | 1.3 | 1.3 |
| 100%-Modulus | 8 | 6 | 3 | 3 | 4 | 3 | 4 | 4 |
| 200%-Modulus | 15 | — | 13 | 8 | 10 | 7 | 7 | 6 |

TABLE 1-continued

| | Reference | Material 1 | Material 2 | Material 3 | Material 4 | Material 5 | Material 6 | Material 7 |
|---|---|---|---|---|---|---|---|---|
| 300%-Modulus | 33 | — | — | — | — | 19 | 16 | 9 |
| Tensile Stress | 41 | 26 | 21 | 28 | 26 | 42 | 37 | 41 |
| Elongation | 323 | 183 | 228 | 265 | 285 | 335 | 355 | 428 |
| Rebound of Blade | A | A | A | A | A | B | B | C |
| Cleaning Performance | B | A | A | B | C | C | D | D |

For the evaluations of the blades on the effect of preventing a rebound, each of the cleaning blades was initially pressed against the photosensitive drum 10 at a pressing force of 30N/m and at a contact angle of 20°, and 100 blank sheets were successively fed through the apparatus under high-temperature and high-moisture circumstances (30° C. and 85% RH). In the meantime, it was examined whether each of the blades rebounded or not. In Table 1, in the row showing the rebound of the blade, the "A" indicates that the blade did not rebound during the 100-sheet feeding. The "B" indicates that the blade rebounded in the middle of the 100-sheet feeding. The "C" indicates that blade rebounded immediately after the 100-sheet feeding. The blades graded with "B" or "C" cannot be used practically. The single-layer blade (reference) and the two-layer blades made of the respective combinations of the reference material and the materials 1 to 4 did not rebound. The two-layer blades made of the respective combinations of the reference material and the materials 5 and 6 rebounded in the middle of the 100-sheet feeding, and the blade made of the combination of the reference material and the material 7 rebounded in an early stage. The blade of which supporting layer has a higher elongation rate under a high stress is more likely to rebound.

For the evaluations of the blades on the cleaning performance, each of the cleaning blades was pressed against the photosensitive drum 10 at a pressing force of 25N/m and at a contact angle of 15°, and a character image with an image coverage of about 5% was printed on 600,000 sheets by repeating a job of printing six sheets in a monochromatic mode under circumstances of 23° C. and 65% RH. Thereafter, under low-temperature and low-moisture circumstances (10° C. and 15% RH), a solid image was printed on ten sheets, that is, ten sheets were fed through the apparatus while the transfer output was on. Thereafter, while the transfer output was off, the solid image was formed on the photosensitive drum, and ten more sheets were fed through the image forming apparatus. The toner remained on the photosensitive drum in these two cases were examined. In Table 1, in the row showing the cleaning performance, the "A" indicates that toner did not pass through the cleaning blade even while the transfer output was off. The "B" indicates that toner passed through the cleaning blade while the transfer output was off but that toner did not pass through the cleaning blade while the transfer output was on. The "C" indicates that toner passed through the cleaning blade even while the transfer output was on, and especially worse cases in the cases of "C" were marked with "D". The blades marked with "A" and "B" are considered to create no practical problems, and the blades marked with "C" and "D" are considered to create practical problems. The single-layer blade as the reference is marked with "B". The examples further using the materials 1 and 2 for the respective supporting layers were ranked higher than the reference, and the example further using the material 3 for the supporting layer was ranked equally to the reference. Also, as the materials 4 to 7 were used for the supporting layer, the cleaning performance got worse and worse.

Moreover, the wear statuses of the blades were checked after the evaluation test on the cleaning performance. The wear statuses substantially agreed with the evaluation results. This shows that a cleaning failure accompanies wear. Further, like the evaluation results on the effect of preventing a rebound, as a material having a higher elongation rate under a high stress is used for the supporting layer, the wear is larger, and the durability is lower.

With the above test results taken together, it is found that a blade having a supporting layer 14*b* made of a material having a smaller elongation rate under a high stress than that of the contact layer 14*a* exerts higher performance than the single-layer blade. In other words, it is of importance in exerting high performance that the respective tensile stress characteristic curves of the material of the contact layer 14*a* and the material of the supporting layer 14*b* intersect with each other.

Each of the examples above were configured such that the contact layer 14*a* and the supporting layer 14*b* have a thickness ratio of 1:3 and have a total thickness of 2 mm. If the blades are configured to be different in the thickness ratio and/or in the total thickness from the examples above, there will be some changes in the effects of suppressing the wear and of preventing a rebound, but the examples using the materials 1 and 2 for the respective supporting layers will keep the same advantages over the single-layer blade.

Further, the tensile stress characteristics were shown by measurement values in accordance with the JIS standard. The characteristics of the cleaning blade are derived from the characteristics of the soft segments and the hard segments as described above with reference to FIG. 4, and the characteristics of the cleaning blade also depends on other characteristics as well as the tensile stress. For example, similar results are obtained in a compression test wherein compression is applied to each example until the example is destructed). Similar results were obtained in a compression test using a micro compression tester.

Although the present invention has been described in connection with the preferred embodiment above, it is to be noted that various changes and modifications are possible for a person skilled in the art. Such changes and modifications are to be understood as being within the scope of the invention.

What is claimed is:

1. A cleaning blade, which is configured to be pressed against a toner image carrier that rotates in one direction, for removing residual toner from the toner image carrier, the cleaning blade comprising:

a polymer contact layer that is located in a side to come into contact with the toner image carrier; and a polymer supporting layer that is located in a side not to come into contact with the toner image carrier, wherein tensile stress characteristic curves of a material of the contact layer and a material of the supporting layer intersect with each other.

2. The cleaning blade according to claim 1, wherein the contact layer and the supporting layer are single layers.

3. The cleaning blade according to claim 1, wherein the tensile stress characteristic of the material of the supporting layer is smaller than the tensile stress characteristic of the material of the contact layer while the materials are in a low-elongation state, and the tensile stress characteristic of the material of the supporting layer is larger than the tensile stress characteristic of the material of the contact layer while the materials are in a high-elongation state.

4. An image forming apparatus, comprising:

a toner image carrier that rotates in one direction; and a cleaning blade, which is pressed against the toner image carrier, for removing residual toner from the toner image carrier, comprising:

a polymer contact layer that is in contact with the toner image carrier; and a polymer supporting layer that is not contact with the toner image carrier, wherein tensile stress characteristic curves of a material of the contact layer and a material of the supporting layer intersect with each other.

5. An image forming apparatus according to claim 4, wherein the contact layer and the supporting layer are single layers.

6. An image forming apparatus according to claim 4, wherein the tensile stress characteristic of material of the supporting layer is smaller than the tensile stress characteristic of the material of the contact layer while the materials are in a low-elongation state, and the tensile stress characteristic of the material of the supporting layer is larger than the tensile stress characteristic of the material of the contact layer while the materials are in a high-elongation state.

7. The cleaning blade according to claim 1, wherein the material of the contact layer or the material of the supporting layer comprises a polyurethane.

8. The cleaning blade according to claim 4, wherein the material of the contact layer or the material of the supporting layer comprises a polyurethane.

9. The cleaning blade according to claim 1, wherein the tensile stress characteristic of the material of the supporting layer can be increased by using a cross-linker that serves to link prepolymer linear components to form meshes.

10. The cleaning blade according to claim 4, wherein the tensile stress characteristic of the material of the supporting layer can be increased by using a cross-linker that serves to link prepolymer linear components to form meshes.

* * * * *